United States Patent [19]

Morin

[11] Patent Number: 4,969,605

[45] Date of Patent: Nov. 13, 1990

[54] DISPOSABLE, DOUBLE-EDGED KNIVES IN GRANULATOR MACHINES

[75] Inventor: Nelson H. Morin, Clearwater, Fla.

[73] Assignee: Eclectic Machine Systems, Inc., Oldsmar, Fla.

[21] Appl. No.: 340,763

[22] Filed: Apr. 20, 1989

[51] Int. Cl.[5] ..... B02C 13/26; B02C 18/00

[52] U.S. Cl. ..... 241/192; 241/242; 241/294

[58] Field of Search ..... 241/192, 195, 242, 243, 241/294, 92

[56] References Cited

U.S. PATENT DOCUMENTS

| | | | |
|---|---|---|---|
| 3,454,234 | 7/1969 | Schoeppner | 241/294 |
| 3,929,296 | 12/1975 | Stoeber | 241/197 |
| 3,981,337 | 9/1976 | Sundström | 241/92 X |
| 4,009,837 | 3/1977 | Schnyder | 241/294 X |
| 4,047,670 | 9/1977 | Svensson | 241/92 |
| 4,694,995 | 9/1987 | Holmberg et al. | 241/92 |

*Primary Examiner*—Timothy V. Eley

*Attorney, Agent, or Firm*—Stanley M. Miller

[57] ABSTRACT

A disposable, double-edged rotor knife and a disposable, double-edged bed knife for use in plastic granulating machines. The rotor knife has a general "Z" shape and is held in sandwiched engagement to the rotor of the machine by a clamp that has a wedge shaped bottom. The clamp wedges the rotor knife into a wedge shaped channel formed in the rotor when a bolt that does not pass through the rotor knife is tightened. In one embodiment, the longitudinal axis of the bolt is parallel to a plane normal to the axis of rotation of the rotor, and in a second embodiment a ten degree angle is formed between the axis of the bolt and the plane. The bed knife is keyed to the machine.

9 Claims, 4 Drawing Sheets

DISPOSABLE, DOUBLE-EDGED KNIVES IN GRANULATOR MACHINES

BACKGROUND OF THE INVENTION

1. Field of the Invention

This invention relates, generally, to rotor knives and bed knives of the type used in comminuting machines. More particularly, it relates to disposable, double edged knives and novel means for mounting them.

2. Description of the Prior Art

Comminuting machines, also known as choppers or granulators, include a rotor or drum member that has at least one cutting blade or knife secured thereto at its radially outermost end. The body of the knife has a bore formed therein and is secured to the rotor by a bolt member that passes through the bore. When the blade becomes dull, the bolt is removed and the blade is removed, reharpened and reinstalled.

Chopping of articles for recycling purposes is accomplished by positioning the article to be chopped between the rotating rotor knife and a stationary bed knife, and reducing the particle size until the particles pass through a grading screen. Thus, the grading screen controls the particle size.

As the rotor knife becomes dull, the space between it and the grading screen widens; the screen loses efficiency and heat builds up in the cutting chamber. Thus there is a need to provide easily replaceable rotor and bed knifes.

Rotor knifes and bed knifes are shown in the following U.S. Pat. Nos.: 4,047,670 to Svensson; 4,694,995 to Holmberg et. al.; 4,351,487 to Haller et. al.; 4,723,717 to Fagnant; 3,419,223 to Morin; 3,559,705 to Salzmann, Jr.; 4,164,329 to Higby; 4,106,708 to Kropa; 4,000,860 to Gotham; 4,545,538 to Prew and 4,545,539 to Steffensen.

SUMMARY OF THE INVENTION

The present invention provides a rotor knife and a bed knife of unique construction. Both knives are disposable and as such are never resharpened. Both knives include double cutting edges, so that when a first cutting edge becomes dull, the knife is rotated one hundred eighty degrees so that the second cutting edge is deployed in its operative position.

The novel rotor knife has no bores formed therewithin. It is secured to the rotor by a clamp that is bored to receive a bolt that is screw threadedly engaged with the rotor. Thus, loosening of the bolt loosens the clamp and permits replacement of the disposable rotor knife or rotation thereof to expose a second cutting edge.

The bed knife is provided with a key and a keyway and is keyed to its holder. Like the rotor knife, it is easily replaceable or rotatable to expose a second cutting edge.

The clamping means that holds the rotor knife harnesses the mechanical advantages derived from wedging. Moreover, another mechanical advantage is realized in one embodiment where the clamping means is offset ten degrees from the axis of symmetry of the rotor.

It is the primary object of this invention to provide disposable rotor knives and disposable bed knives for use in granulating machines.

Another important object is to provide new means for mounting rotor knives to rotors and new means for mounting bed knives to beds.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

Similar reference numerals refer to similar parts throughout the several views of the drawings.

DETAILED DESCRIPTION OF THE PREFERRED EMBODIMENT

Figure 1:
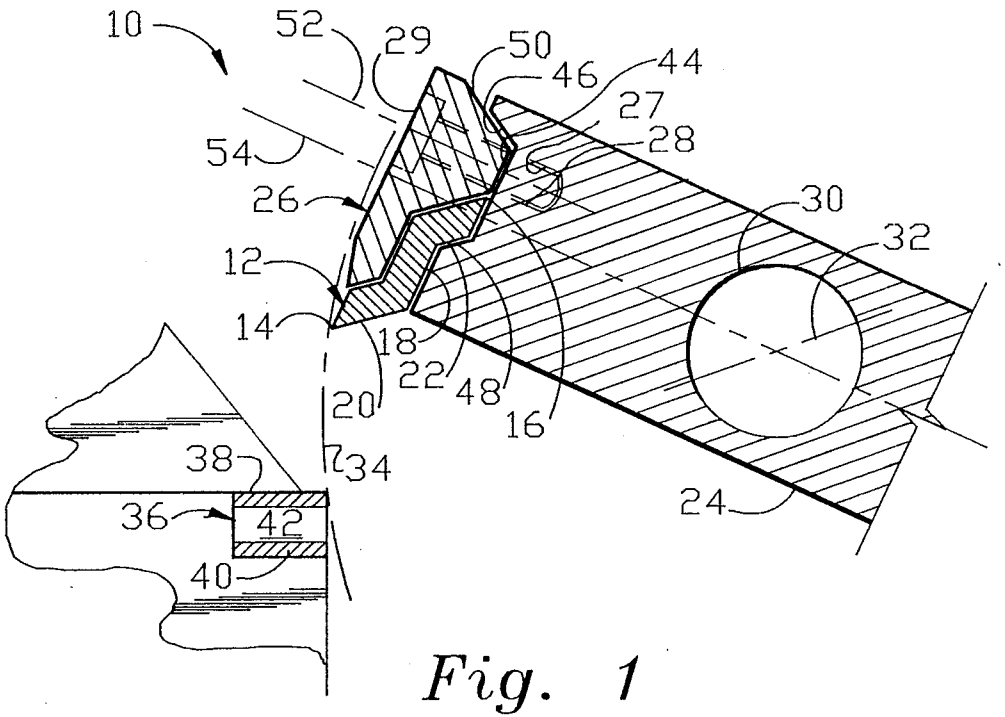
FIG. 1 is a side elevational view of a rotor, a rotor knife and a bed knife of a first embodiment of this invention.

Referring now to FIG. 1, it will there be seen that a first illustrative embodiment of the present invention is denoted 10 as a whole. The novel double edged rotor knife is denoted 12. Rotor knife 12 is generally "Z"-shaped as shown and includes first cutting edge 14 and second cutting edge 16. The medial part of knife 12 is denoted 18 and the integral opposite ends of the knife are denoted 20, 22. Opposite ends 20, 22 lie in parallel planes and are angled with respect to medial part 18 of the knife as shown; the angle is about forty five degrees.

Knife 12 is disposed in sandwiched relation between rotor 24 and clamp 26; clamp 26 and rotor 24 are suitably bored and threaded as at 27 to screw threadedly receive an elongate bolt member 28. Clamp 26 is countersunk as shown to fully receive the head 29 of bolt 28.

Rotor 24 is rotatably mounted to rod 30 of a conventional granulating machine, not shown. The rotational axis of symmetry of rod 30 is denoted 32. When knife 12 rotates about axis 32, edge 14 thereof follows a circular path of travel denoted 34.

A material being chopped, not shown, is subjected to a scissors action as edge 14 of blade 12 sweeps past stationary bed knife 36.

The bed knife 36 of this invention is also novel. It includes a first edge 38, a second edge 40, and a medial part 42. Its novel mounting will be described hereinafter.

Importantly, rotor knife 12 is a solid element, having no bores formed therein. Bolt 28 passes behind rotor knife 12, as illustrated, and the knife is held in its operable position solely by the clamping action of clamp 26.

It should be observed that the clamping action of clamp 26 incorporates a mechanical wedging action. More particularly, the radially outermost end of rotor or drum 24 has a channel formed therein; the flat bottom of the channel is denoted 44 and the sloping side walls thereof are denoted 46, 48.

Clamp 26 includes a back wall 50 that wedgingly engages sloping channel side wall 46 as shown and end 22 of rotor knige 12 wedgingly engages sloping channel wall 48 as shown. Thus, tightening of bolt member 28 drives both the rotor knife 12 and clamp 26 into the channel, thereby ensuring a tight mechanical clamping of knife 12 into position. Clamp 26 is contoured to fit around knife 12 as shown.

When first edge 14 of knife 12 becomes worn, knife 12 need not be resharpened. Instead, bolt 28 is loosened and knife 12 is rotated one hundred eighty degrees to the position shown in FIG. 2; the bolt is then retightened. It will be noted in FIG. 2 that second edge 16 is now prepared to chop material and first edge 14 is now occupying the former position of second edge 16. Bed knife 36 has also been reversed in FIG. 2 so that second edge 40 is now the primary cutting edge.

Figure 2:
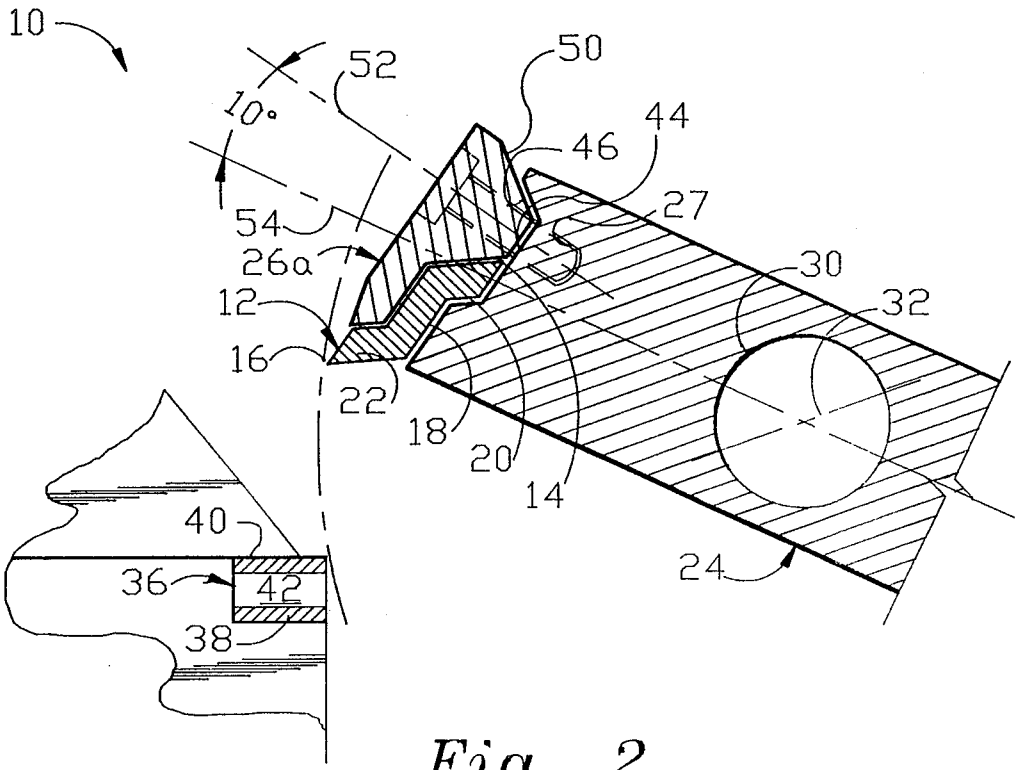
FIG. 2 is a side elevational view similar to that of FIG. 1, but showing a second embodiment of the invention.

There is also a difference in configuration, as illustrated, between the clamp **26*a* of FIG. 2 and clamp 26 of FIG. 1. However, the channel formed in rotor 24 and the above-described wedging action are configured the same, as indicated by the reference numerals in FIG. 2**.

More importantly, it should be noted in FIG. 1 that the longitudinal axis of symmetry 52 of bolt 28 is parallel to the longitudinal axis of symmetry 54 of rotor 24; in FIG. 2 there is a ten degree angle between said respective longitudinal axes. The ten degree angle also affects the channel formed in the radially outermost end of rotor 24 as well; more particularly, as shown in FIG. 1, bottom wall 44 of the channel is normal to axes 52, 54 whereas in FIG. 2, the angle between said bottom wall 44 and axis 54 of rotor 24 is one hundred degrees.

The angle between bottom wall 44 and bolt 28 axis 52 remains ninety degrees. The provision of the ten degree angle enhances the mechanical tightening of clamp **26*a* against rotor 24 and orients knife 12** at a novel angle to substantially enhance its effectiveness.

Figure 3:
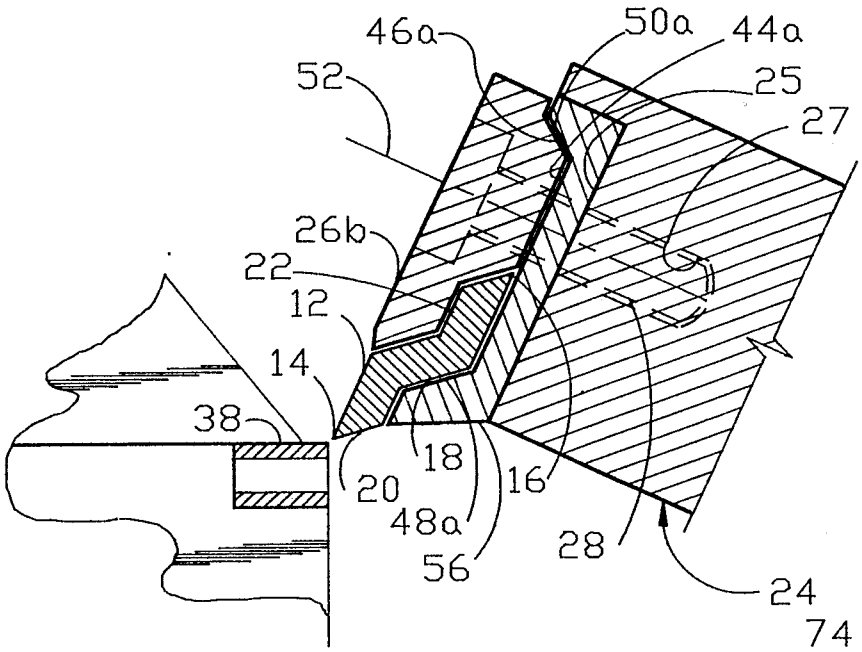
FIG. 3 is another side elevational view similar to that of FIG. 1, but showing a third embodiment of the present invention.

A third embodiment is shown in FIG. 3; the longitudinal axis 52 of bolt 28 can be parallel to the longitudinal axis 54 of rotor 24 or offset therefrom by a ten degree angle. FIG. 3 should be taken as depicting both designs.

FIG. 3 depicts a clamp base member 56 that is not provided in the embodiments of FIGS. 1 and 2. No channel is formed in the radially outermost end of rotor 24 in this embodiment as in the other embodiments; instead, the radially outermost surface of the rotor or drum 24 has an "L"-shaped cut away part 25 formed therein as shown to accommodate clamp base member 56. The channel with the sloping side walls is formed in clamp base member 56. The forward sloping side wall **48*a* is elongated in this embodiment with respect to the above-described embodiments. Importantly, straight part 18 of the rotor knife 12 overlies this sloping forward wall 48*a* as shown; this contrasts with the other embodiments where the angled outer parts 20 or 22 of the knife 12 were disposed in overlying relation with sloping forward wall 48. In all embodiments, however, a wedging action is accomplished along sloping forward wall 48 and the part of knife 12** that overlies it.

Figure 4:
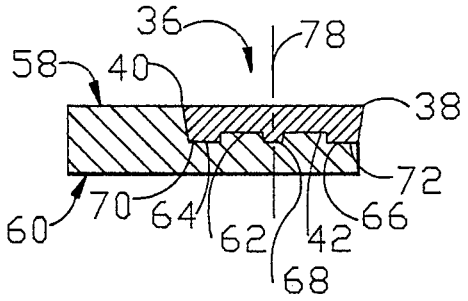
FIG. 4 shows an alternate design for the bed knife and a unique mounting means therefor.

The novel means for mounting the novel bed knife is shown in FIG. 4. Holder 58 is similar to conventional granulating machine bed knife holders in all respects except that its inner end 60 is cut away in the manner shown to provide a novel mounting means for bed knife 36.

More specifically, inner end 60 is cut away to provide a key means 62 that is raised with respect to channels 64, 66 that flank said key means as shown.

Bed knife 36 has a complementally formed key way 68 that slidingly receives key 62. Key way 68 is flanked by raised parts 70, 72 that are slideably received within channels 64, 66, respectively.

It should therefore be clear that when edge 38 of knife 36 becomes dull, it is a simple matter to slide knife 36 out of holder 58 (the sliding movement will displace knife 36 out of or into the plane of the paper), to reverse the knife, and to reinsert it with edge 40 disposed in the same position of edge 38 in FIG. 4.

Figure 5:
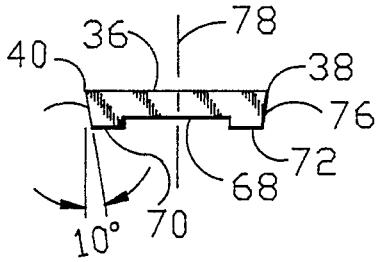
FIG. 5 shows the bed knife in end elevation.

Bed knife 36 is shown alone in FIG. 5. Side walls 74, 76 are angled toward one another at a ten degree angle relative to the vertical axis of symmetry of knife 36. Thus, as is better understood in connection with FIG. 4, a wedging action is established between either side wall 74 or 76 of knife 36 and knife holder 58, depending upon which edge 38, 40 is providing the cutting edge of the chopper. As is clearly shown in FIGS. 1–3, rotor knife 12 has a rotary downward action as it sweeps past bed knife edge 38 or 40; the forces that act on bed knife 36 as the material being chopped bears against it serve to wedgingly drive either side wall 74 or 76 into the complementally formed sloping side wall 58 as is clearly depicted in FIG. 4.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described, what is claimed is:

1. In a granulating machine, comprising:

a generally "Z"-shaped knife member having a straight medial part integral with a first outer part and a second outer part;

said first and second outer parts being disposed parallel to one another and being disposed at a common predetermined angle with respect to said medial part;

said first outer part of said knife member terminating in a first cutting edge and said second outer part of said knife member terminating in a second cutting edge;

said knife member being a solid body;

a rotating drum to which said knife member is secured;

clamping means for clamping said knife member to a radially outer end of said rotating drum;

and said drum having a channel means formed in its radially outermost surface;

said clamping means and said channel means being wedgingly engaged with respect to one another;

said clamping means including a clamp member having a bore means formed therethrough, wherein said drum member has a bore means formed therein in axial alignment with the bore means formed through said clamp member, wherein said drum member bore means is threaded, and wherein a bolt member extends through said clamp member bore means and screw threadedly engages said drum member bore means so that tightening of said clamping means is accomplished by screw threaded advancement of said bolt member and loosening of said clamping means is accomplished by screw threaded retraction of said bolt member;

said knife having a channel member having inwardly sloping side walls formed in a radially outermost end of said drum member;

whereby when a first cutting edge of said knife member becomes dull through use, said clamping means is loosened, and said knife member is rotated one hundred eighty degrees to expose said second cutting edge, and whereby when said second cutting edge becomes dull through use, said clamping means is loosened and said knife member is discarded.

2. The machine of claim 1, wherein the common predetermined angle between said outer parts and said medial part is about forty five degrees.

3. The machine of claim 1, wherein said clamping member has a base that includes inwardly sloping side walls that slope at the same angle as the side walls of said channel.

4. The machine of claim 3, wherein the inwardly sloping side walls of the clamping member base wedgingly engage the inwardly sloping side walls of the channel member as the bolt member is tightened.

5. In a granulating machine, comprising:

a rotatably mounted rotor member having an "L"-shaped cut away part in its radially outermost surface;

a generally "Z"-shaped double edged knife having a straight medial part and having outer parts angled with respect to the medial part, each of which terminates in a cutting edge;

a clamp member;

said clamp member having a base part that includes forward and rearward sloping walls that converge toward one another;

a clamp base member having an "L"-shaped base part that is complementally formed with respect to the "L"-shaped cut away part formed in said rotor member;

a channel member formed in a top wall of said clamp base member;

said channel member having forward and rearward sloping walls that converge toward one another;

said sloping walls of said clamp member being complementally formed with respect to the sloping walls of said clamp base member so that said channel member formed in said clamp base member wedgingly receives said base part of said clamp member;

a bore means formed in said clamp member, said clamp base member, and said rotor member;

said rotor knife being disposed in sandwiched relation between said clamp member and said clamp base member;

said straight part of said rotor knife overlying said sloping forward wall; and a bolt member screw threadedly received within said bore means to wedgingly drive said clamp member and said rotor knife into said channel member when said bolt member is tightened.

6. The machine of claim 5, wherein the longitudinal axis of symmetry of said bolt member is parallel to the longitudinal axis of symmetry of said rotor member.

7. The machine of claim 6, wherein the longitudinal axis of symmetry of said bolt member is disposed at a ten degree angle relative to the longitudinal axis of symmetry of said rotor member.

8. The machine of claim 7, wherein said machine includes a disposable bed knife having double knife edges, said bed knife being removably mounted to said machine so that a second knife edge thereof is disposed in cutting relation to said rotor knife when a first knife edge thereof is worn.

9. The machine of claim 8, wherein said bed knife is keyed to a bed means of a granulating machine.

* * * * *